US005340207A

United States Patent [19]

Chen

[11] Patent Number: 5,340,207

[45] Date of Patent: Aug. 23, 1994

[54] FOLDABLE ASSEMBLY CABINET

[75] Inventor: Shun-Teng Chen, Tao Yuan Hsien, Taiwan

[73] Assignee: Shern Diau Enterprise Co., Ltd., Tao Yuan Hsien, Taiwan

[21] Appl. No.: 19,629

[22] Filed: Feb. 18, 1993

[51] Int. Cl.[5] ..... A47B 87/00; A47B 43/00; A47B 47/00

[52] U.S. Cl. ..... 312/262; 312/108

[58] Field of Search ..... 312/258, 262, 108, 205, 312/199

[56] References Cited

U.S. PATENT DOCUMENTS

| | | | |
|---|---|---|---|
| 578,445 | 3/1897 | Cobleigh | 312/262 X |
| 3,797,905 | 3/1974 | Naske | 312/262 |
| 4,057,308 | 11/1977 | Dunning, III | 312/258 X |
| 4,109,985 | 8/1978 | Lieb, Jr. | 248/311.1 R |
| 4,747,644 | 5/1988 | Gallery et al. | 312/262 X |

*Primary Examiner*—Kenneth J. Dorner
*Assistant Examiner*—Nancy Mulcare
*Attorney, Agent, or Firm*—Browdy and Neimark

[57] ABSTRACT

A foldable assembly cabinet having the parts thereof formed by injection molding can be collaped into a compact size without disassembly thereof for effective reduction of the packing volume so as to facilitate the delivery thereof in one aspect and lower the cost of transportation in another. The cabinet includes a case body, a left and a right side board, a top lid and a bottom board and a number of partition boards. The left side board and the right side board are pivotally secured to the case body and the right side board is made wider than the left side board so that the former can be folded in superposition on top of the latter; and the two side boards are located in abutment against the folded top lid and bottom board in the collapsing of the cabinet. Each of the side boards and top lid and the bottom board and the partition boards of the cabinet is provided with a grid-like reinforcement structure. Both the right and left side boards are provided with a sliding trough respectively so as to permit a flexible roll-up door housed in a hollow space of the case body to be slidably mounted thereto.

7 Claims, 9 Drawing Sheets

FOLDABLE ASSEMBLY CABINET

BACKGROUND OF THE INVENTION

The present invention relates to a foldable assembly cabinet all the parts of which are made by way of injection molding. The cabinet includes a top lid, a bottom board, a left side board, a right side board each of that is pivotally coupled to a main case body so as to permit the same to be folded into a compact size and also expanded in a particular order, making the delivery expense thereof lower by reducing the size of packing.

Cabinets or cupboards have been widely employed at different places, such as offices, study rooms, bath rooms and stores for storage of various articles, like files, books, merchandise and bathing towels, shoes and etc. These prior art cabinets are generally made of wood or metal in a bulky size and heavy weight, making the delivery thereof difficult and expensive as a result of the invariable size and excessive weight in one aspect; and the wood and metal used are easily worn out with time in another aspect.

SUMMARY OF THE INVENTION

Therefore, the primary object of the present invention is to provide a foldable assembly cabinet which is provided with a pivotal top lid, a bottom board, a left side board, a right side board that are foldably secureded to a case body so that the cabinet can be readily collapsed into a compact size for delivery.

Another object of the present invention is to provide a foldable assembly cabinet whose parts are made by way of injection molding so as to keep the same light in weight.

One further object of the present invention is to provide a foldable assembly cabinet which can be delivered in a compact size and at low cost.

One still further object of the present invention is to provide a foldable assembly cabinet which is durable for use.

One still further object of the present invention is to provide a foldable assembly cabinet which is provided with a flexible roll-up door slidably associated with the left and right side boards each of which is provided with a guide trough on the inner wall thereof.

DETAILED DESCRIPTION OF THE PREFERRED EMBODIMENT

Figure 1:
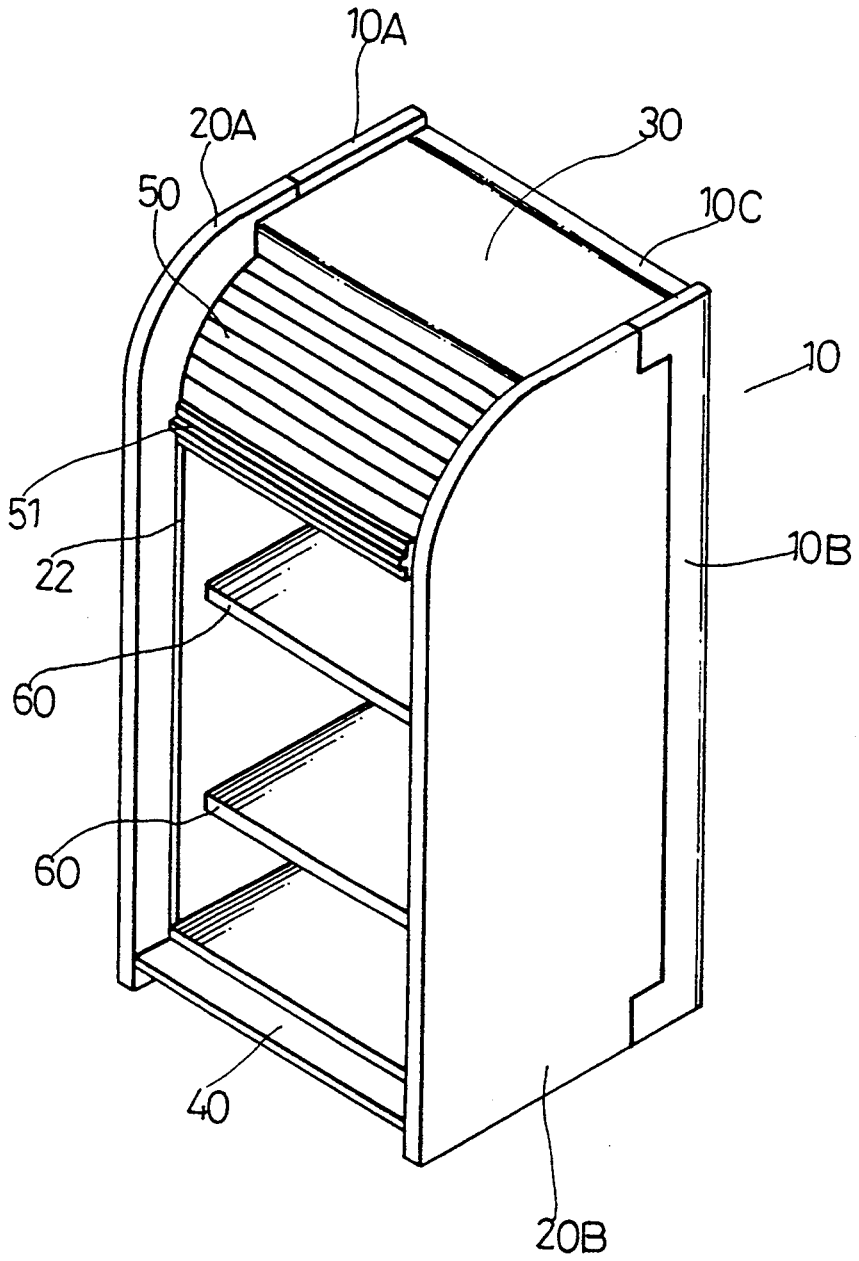
FIG. 1 is a perspective view of the cabinet of the present invention, showing a flexible roll-up door.
Figure 2:
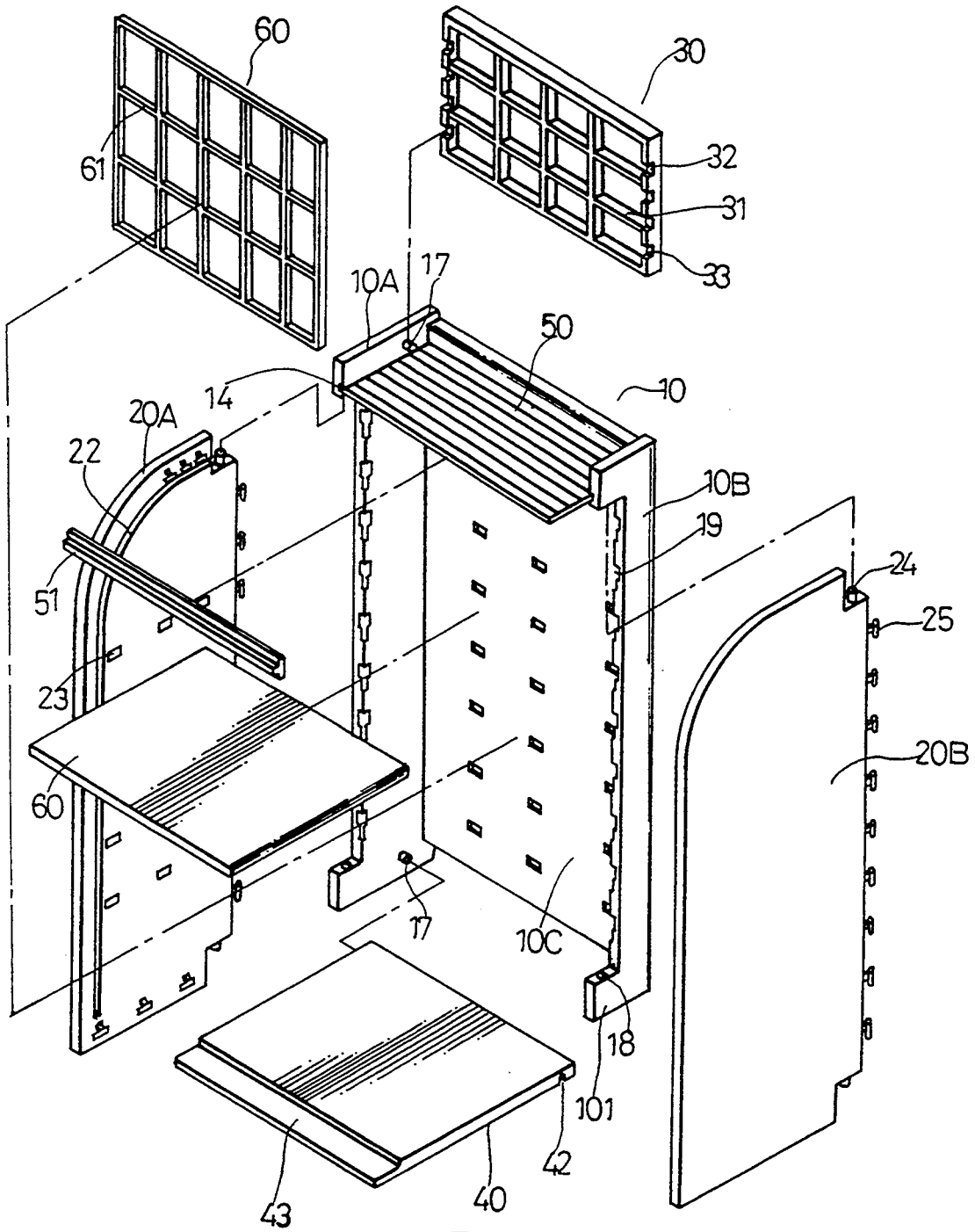
FIG. 2 is a perspective view of the exploded components of a the present invention.
Figure 3A:
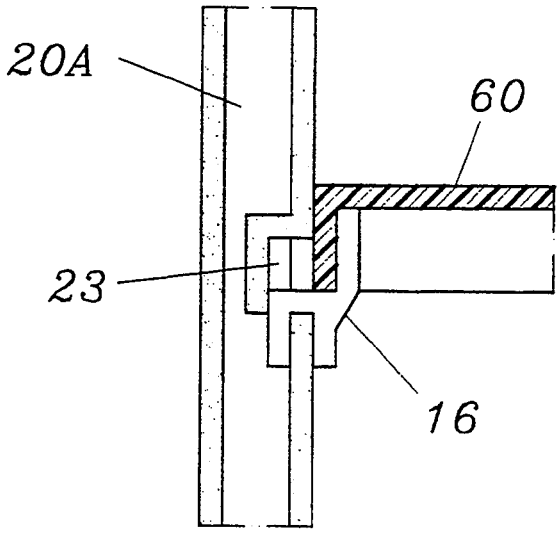
FIG. 3A is a diagram showing a partition board being supported in place.
Figure 3B:
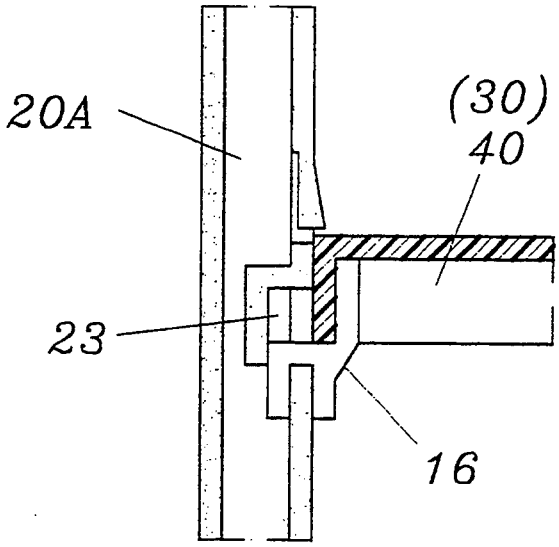
FIG. 3B is a diagram showing the way in which the top lid and bottom board are supported in place.

Referring to FIGS. 1, 2, the foldable assembly cabinet of the present invention is comprised of a case body 10, a left side board 20 A, a right side board 20 B, a top lid 30 and a bottom board 40. On the inner wall of both the left side and right side boards 20 A, 20 B, there is provided with an enlongated guide trough 22 disposed in parallel with the edge of each side board respectively. A number of spaced partition boards 60 can be removably located in parallel between the top lid 30 and the bottom board 40. A flexible roll- up door 50 having an grip edge 51 at the end thereof is slidably assoicated with the guide troughs 22 so as to permit the roll-up door to be pulled downwardly or pushed upwardly for closing or opening the cabinet. All the above cited components are made of plastics by way of injection molding and are assembled with ease.

As further shown in FIG. 2, the vertical edge 201 of both the left and right side boards 20 A, 20 B is provided with a plurality of equally spaced horizontal supporting hinges 25 and a vertically disposed pivot pin 24 at each end thereof which is respectively engaged with a hole 18 disposed on the left side plate 10 A and the right side plate 10 B of the case body 10. In correspondence to the horizontal supporting hinges 25, a plurality of retaining cavities 19 are disposed on the case body 10 whereby the side boards 20 A, B can be pivotally secured to the case body 10, as clearly shown in FIG. 2 . The bottom board 40 is provided with a pair of retaining recesses 42 at each end thereof which is engaged with a horizontal protrusion rod 17 located on the inner wall of each side plate 10 A, 10 B of the case body 10 so as to permit the bottom board 40 having a stepwise front 43 to be pivotally operated.

Figure 10:
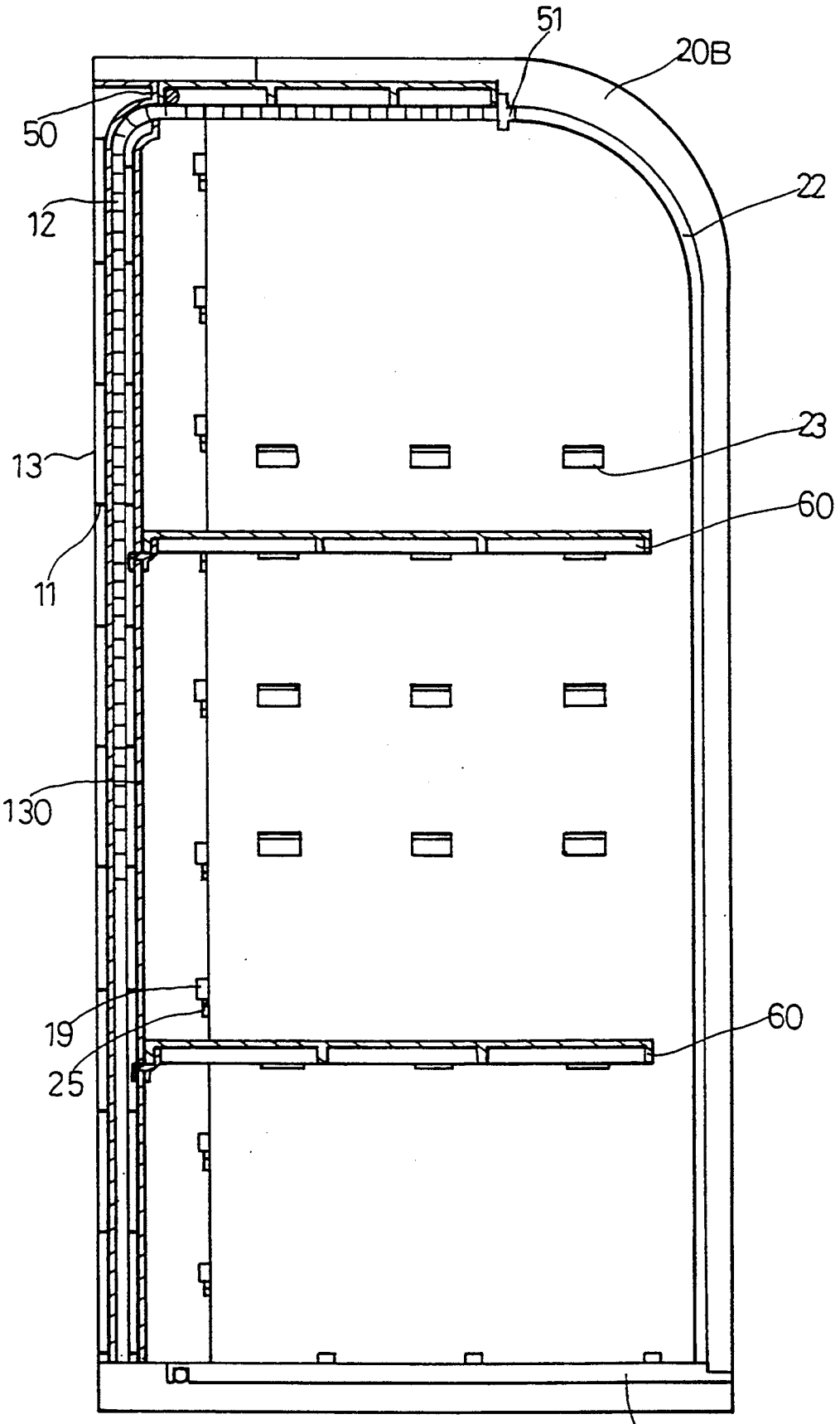
FIG. 10 is a sectional view of the present invention.

The case body 10 is comprised of the left side plate 10 A, the right side plate 10 B, a back wall 10 C having a front plate 130 and a rear plate 13 that are associated with each other with a room 12 left therebetween so that the flexible roll-up door 50 can be housed therein, as shown in FIG.10. The front plate 130 is provided with a grid-like reinforcement rib 11 which are used to bulild up the strength of the plates and makes the weight thereof light, as shown in FIG. 10. A guide trough 14 disposed on each left and right side plate 10 A, 10 B of the case body 10 and in alignment with the guide trough 22 of each corresponding side board 20 A, 20 B enables the roll-up door 50 to slide therealong in operation.

Figure 9:
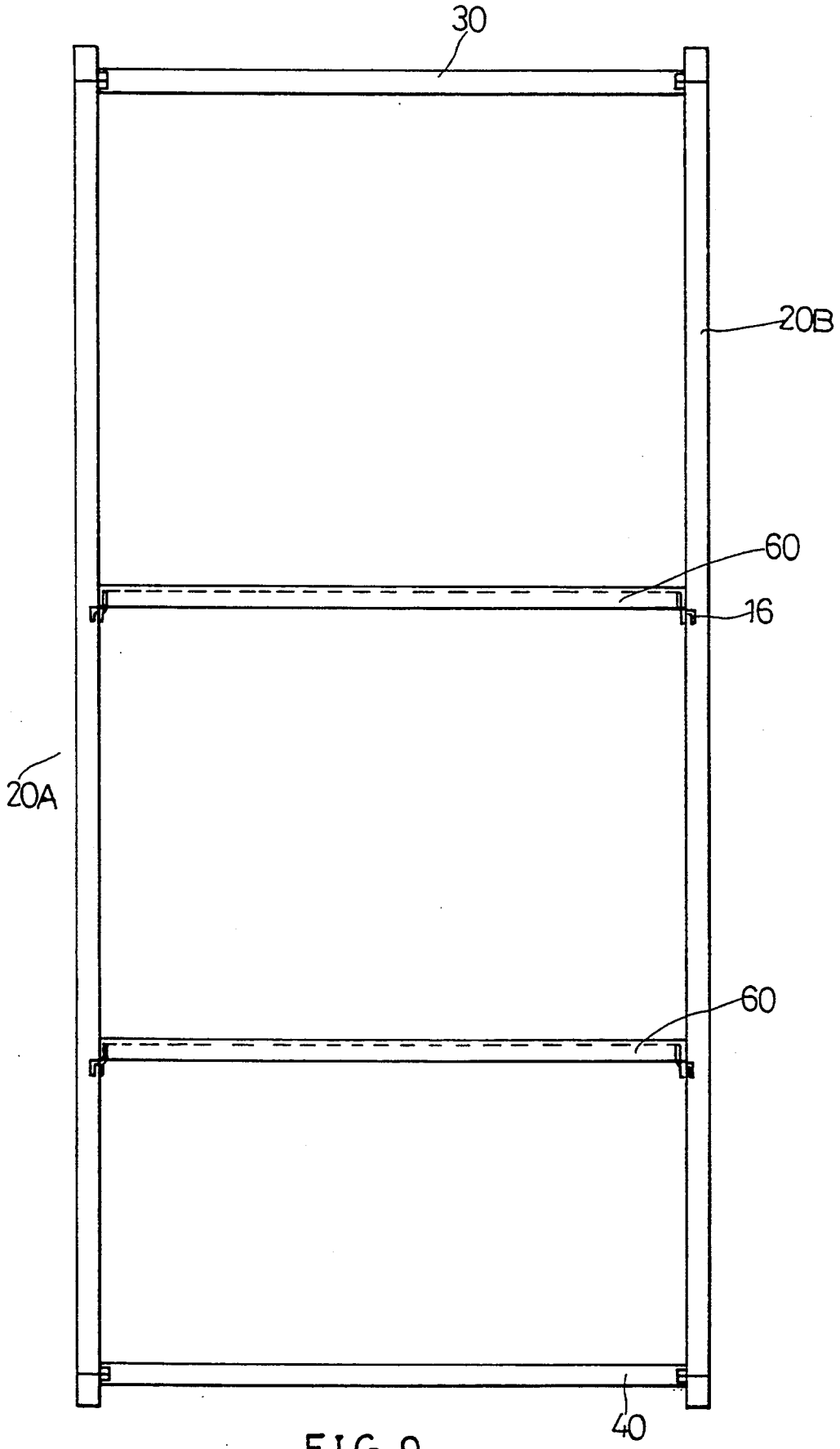
FIG. 9 is a front view of the present invention.

On the wall of the front plate 130 are disposed a plurality of fixing cavities 15 arranged in order all thereover. With each fixing cavity 15 is engaged a supporting unit 16 so as to support a partition board 60 in place, as shown in FIG. 9. On each side plate 10 A or 10 B is disposed a pivot protrusion 17 at both the top and the bottom end of the rear side thereof so that the top lid 30 and the bottom board 40 can be pivotally engaged therewith. Each side plate 10 A or 10 B of the case body 10 is provided with a pair of extension legs 101, at the top and bottom end thereof respectively with a fixing hole 18 disposed on each leg so that the left side and right boards 20 A, 20 B can be pivotally mounted to the case body 10 with the pivot pins 24 engaged with the fixing holes 18.

The left side board 20 A is made smaller in width than the right side board 20 B so that the latter can be pivoted first inwardly following the inward collapse of the top lid 30 and the bottom board 40, then the former is pivoted into position right in contact with the latter whereby the cabinet of the present invention can be folded in a compact size. Both the left side and right side boards 20 A, 20 B are in a hollow form with two pieces of board joined together one of which is provided with a grid-like reinforcement rib so as to effectively build up the strength thereof without increasing excessive weight to the same.

The top lid 30 is provided with a grid-like reinforcement rib 31 on the underside thereof and equipped with an engagement recess 33 at each end of both sides thereof which is respectively engaged with the pivot protrusion 17 disposed on each side plate 10 A, 10 B so as to permit the top lid 30 to be pivotally operated. A number of locking cavities 32 are disposed on the same side of the engagement recess 33 whereby the top lid can be firmly supported in place by the supporting units 16 which are firmly engaged with the fixing cavities 23 that are planted in order on the surface of the left and right side boards 20 A, 20 B.

Figure 12:
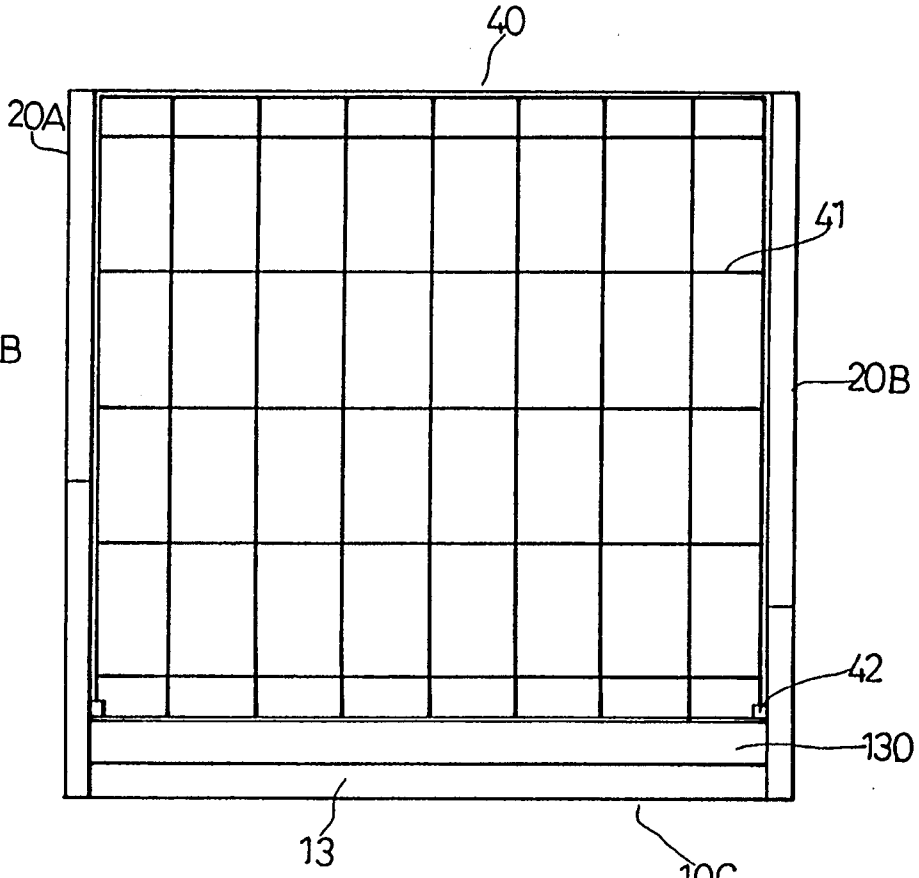
FIG. 12 is a bottom view of the present invention.
Figure 11:
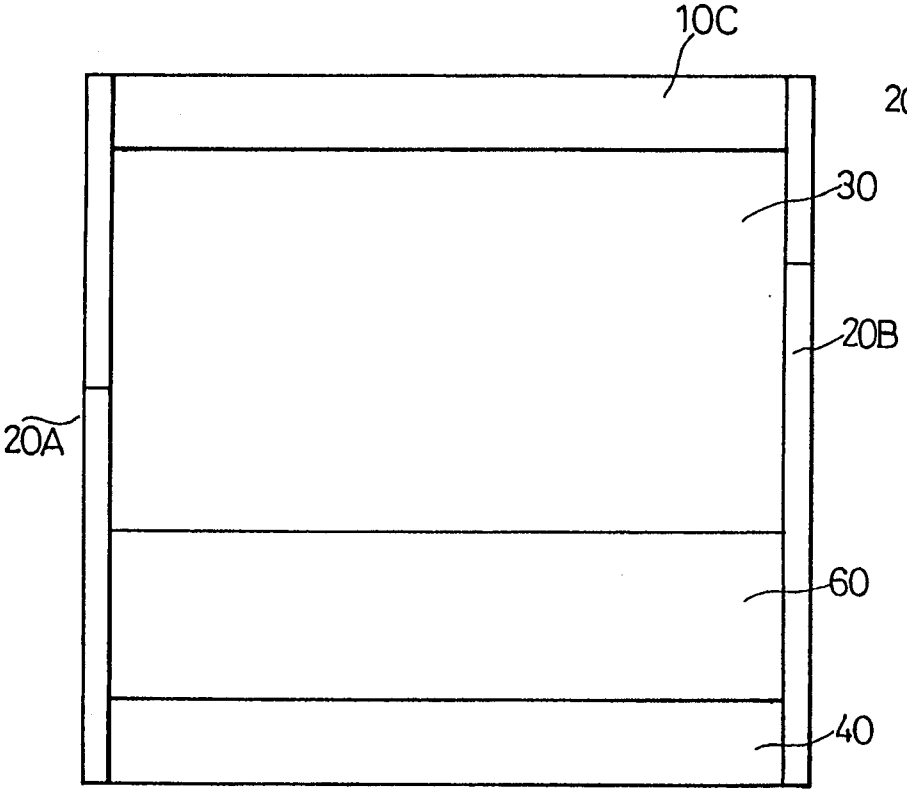
FIG. 11 is a top view of the present invention.

The bottom board 40 is provided with a grid-like reinforcement rib 41 on the underside thereof, as shown in FIG. 12 ; an engagement recess 42 disposed at each end of the left and right side thereof is engaged with the pivot protrusion 17 disposed at the bottom of the left and right side plate 10 A,10 B respectively so as to permit the same to be pivotally operated. The bottom board 40 can also be positioned by the supporting units 16 engaged with the lower fixing cavities 23 on the left and right side board 20 A, 20 B respectively. The front side of the bottom board 40 is provided with a stepwise front extension 43 so as to allow the roll-up door 50 to tightly engaged with the bottom board 40 thereat, preventing water from splashing into the cabinet disposed in a bathroom or the like.

The roll-up door is provided with a grip edge 51 at the front end thereof. The partition board 60 provided with a reinforcement frame 61 at the underside thereof can be selectively secured in place to the surface of the case body 10 and the left and right side boards 20 A, 20 B at a proper position so that articles can be located thereon.

Figure 4:
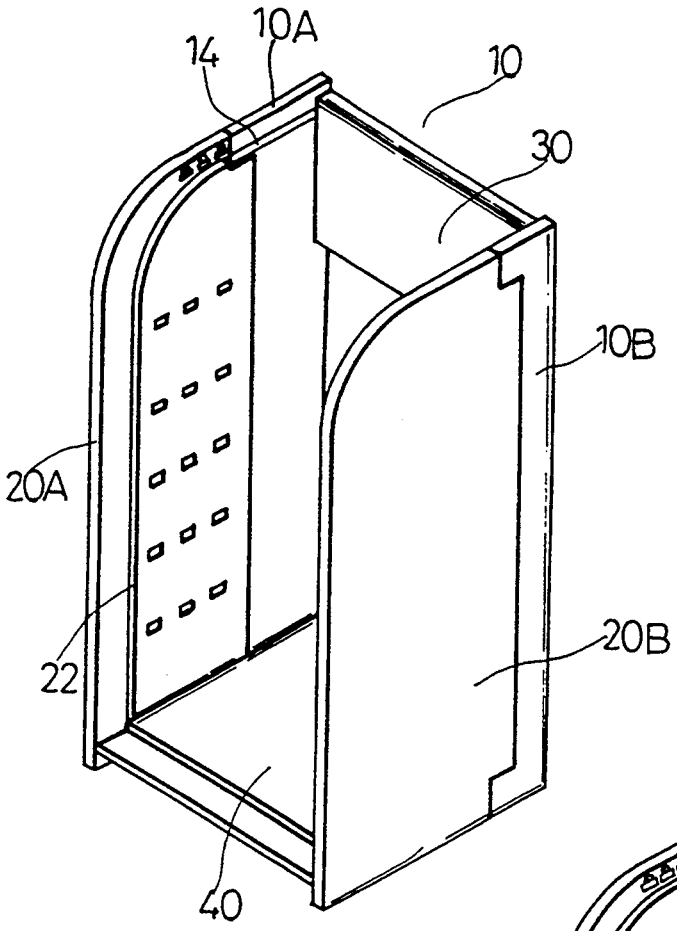
FIG. 4 is a diagram showing the top lid being pivoted downwardly against the case body.
Figure 5:
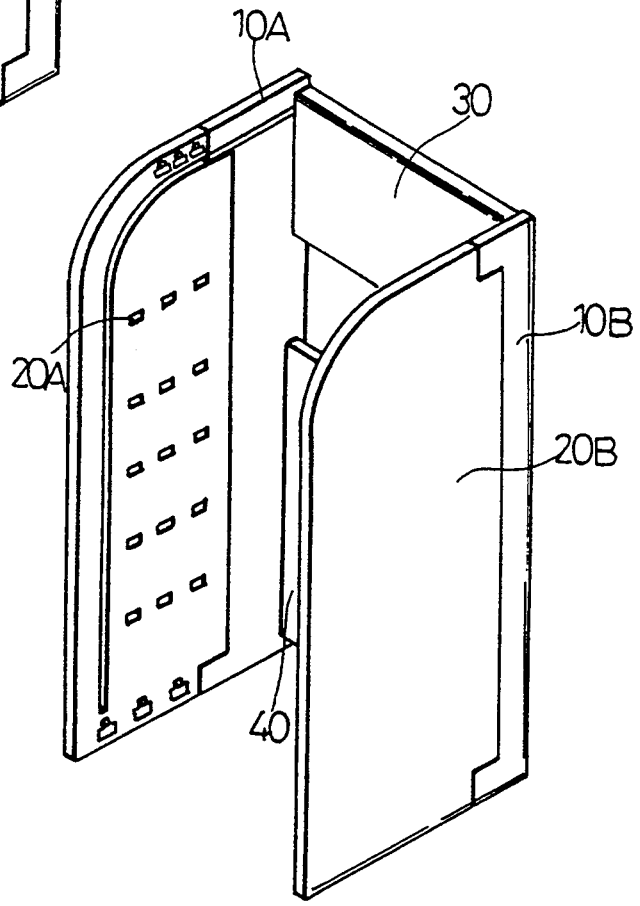
FIG. 5 is a diagram showing the bottom board being pivoted upwardly against the case body.
Figure 6:
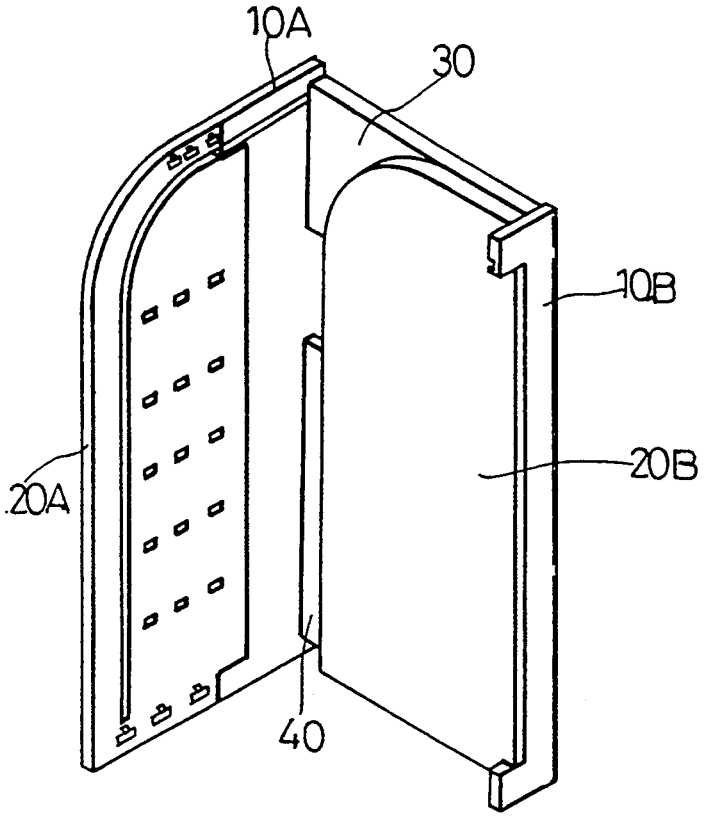
FIG. 6 is a diagram showing the right side board being pivoted inwardly against the folded top lid and bottom board.
Figure 7:
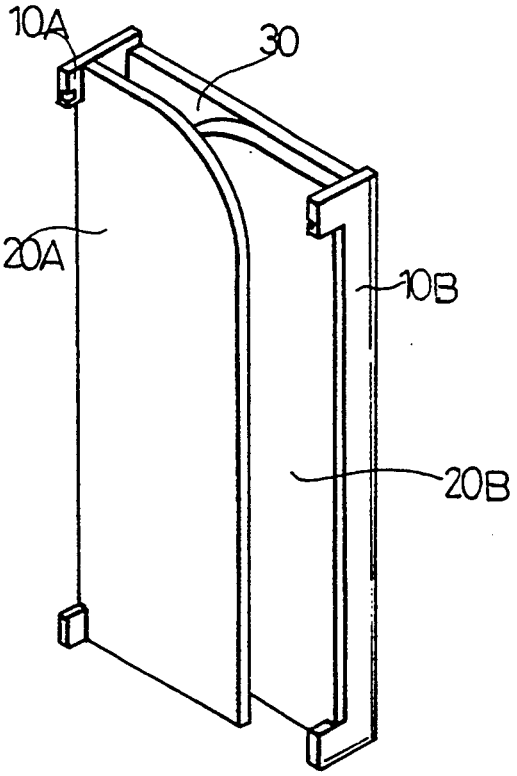
FIG. 7 is a diagram showing the left side board pivoted against the folded right side board.
Figure 8:
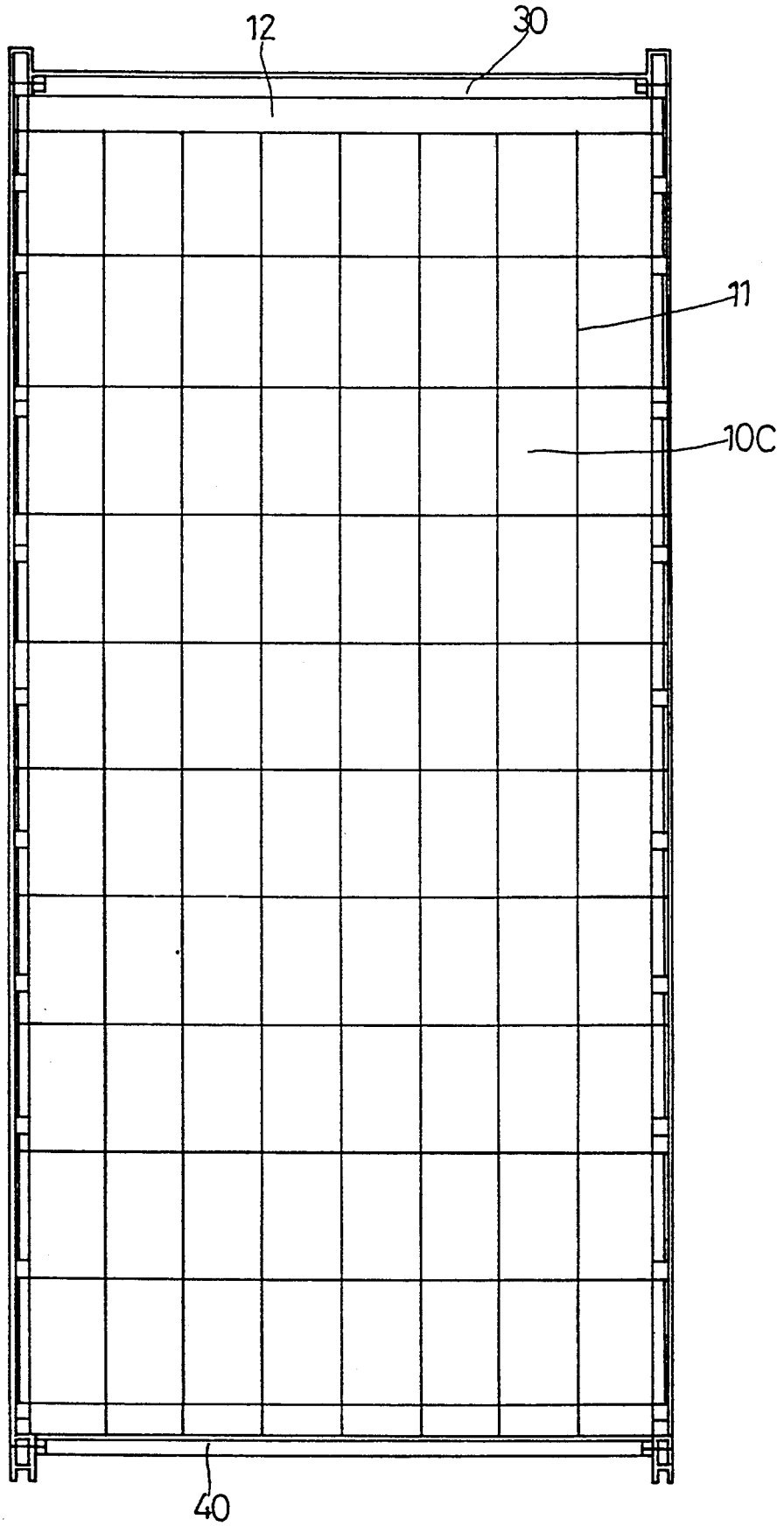
FIG. 8 is a diagram showing the structure of the rear plate of the case body.

To get the cabinet folded into compact size, the partition boards 60 are first removed from the cabinet, then the following steps are taken in a specific order:

( 1) the top lid 30 is pivoted downward against the case body, as shown in FIG.4;

( 2) the bottom board 40 is pivoted upward in abutment against the case body, as shown in FIG. 5 ;

( 3) the right side board 20 B is pivoted inwardly against the case body, as shown in FIG. 6 ;

( 4) the left side board 20 A is finally pivoted toward and abuts against the folded right side board 20 B, as shown in FIG. 7.

Now, it can be clearly seen that the present invention has the following advantages:

1. The components of the present invention are made by way of injection molding so as to effectively reduce the cost of production.
2. Each board or plate of the present cabinet is provided with a grid-like reinforcement structure so as to reduce the weight of the structure of the cabinet and build up the strength thereof at the same time.
3. The cabinet can be folded into compact size without disassembly in packing operation so as to save the time used in assembly and also minimize the packing volume and delivery expense thereof .
4. The cabinet of the present invention is rather light, facilitating the transportation with little effort.
5. The plastic material used in the present invention is resistive against corrosion due to moisture so as to prolong the opertion life thereof.

I claim:

1. A foldable assembly cabinet, comprising:

a case body having a left side plate and a right side plate and a back wall having a front plate and a rear plate;

a top lid pivotally associated with said case body;

a left side board pivotally secured to said case body;

a right side board pivotally secured to said case body; said left side board and said right side board being provided with a plurality of fixing cavities arranged in order all thereover;

a number of partition boards removably disposed between said left side and right side board and said top lid and bottom board;

said front plate of the back wall of said case body being provided with a plurality of fixing cavities arranged in order all thereover;

a plurality of supporting units removably engaged with said fixing cavities disposed on said side boards and said back wall respectively so as to retain said partition boards in place;

said right side board being larger than said left side board so as to permit said right side board to be pivoted against said case body first then said left side board being pivoted next toward the folded right side board and in abutment against the same;

whereby said cabinet can be folded into compact size without disassembly by first pivoting said top lid and said bottom board toward said case body and then pivoting said right side board toward and in abutment against said folded top lid and bottom board, and said left side board being pivoted toward and in abutment against said folded right side board in a consecutive order.

2. A foldable assembly cabinet as claimed in claim 1 wherein all said assembly parts are manufactured by way of injection molding.

3. A foldable assembly cabinet as claimed in claim 1 wherein both said left side board and said right side board are made up of two pieces of plates one of which is provided with a grid-like reinforcement rib and that are engaged with each other so as to build up the strength thereof.

4. A foldable assembly cabinet as claimed in claim 3 wherein said left side board and said right side board and said left side plate and said right side plate of said case body are provided with a guide trough on the inner surface thereof so that a flexible roll-up door housed in the hollow space of said case body can be pulled extendedly to cover said cabinet or to be pushed to withdraw into said hollow space to keep said cabinet opened.

5. A foldable assembly cabinet as claimed in claim 4 wherein said left side board and said right side board are provided with a plurality of spaced horizontal supporting hinges on one side thereof which are removably engaged with corresponding retaining cavities disposed on the outer edge of said left side plate and said right side plate respectively so as to permit said left side board and right side board to be pivoted inwardly toward said case body.

6. A foldable assembly cabinet as claimed in claim 4 wherein said top lid is supported by a number of supporting units that are removably secured to a number of corresponding fixing cavities disposed on the inner wall of said left side board and said right side board and said top lid can be only pivoted downwardly.

7. A foldable assembly cabinet as claimed in claim 4 wherein said bottom board is fixed in place by way of said supporting units that are removably secured to a number of corresponding fixing cavities disposed on the inner wall of said left side board and said right side board and said bottom can be only pivoted upwardly.

* * * * *